United States Patent [19]

Zentner

[11] Patent Number: 4,830,588

[45] Date of Patent: May 16, 1989

[54] CAPILLARY PRIMED PUMP

[75] Inventor: Ronald C. Zentner, Bellevue, Wash.

[73] Assignee: The Boeing Company, Seattle, Wash.

[21] Appl. No.: 133,544

[22] Filed: Dec. 16, 1987

[51] Int. Cl.[4] ..... F04B 19/16; F04B 29/00; F04B 21/02

[52] U.S. Cl. ..... 417/460; 417/53; 417/526; 417/538

[58] Field of Search ..... 417/53, 526, 538, 460

[56] References Cited

U.S. PATENT DOCUMENTS 1,189,165 6/1916 Ness ..... 417/526

1,378,543 5/1921 Johnson ..... 417/526

2,407,790 9/1946 Le Tourneau ..... 417/526

4,547,130 10/1985 Eastman ..... 417/53

*Primary Examiner*—William L. Freeh

*Attorney, Agent, or Firm*—Christensen, O'Connor, Johnson & Kindness

[57] ABSTRACT

A positive displacement pump useful under zero-gravity conditions is primed by the capillary wicking action of a fluid accumulator and a set of capillary plates located in a pair of pumping chambers. The fluid accumulator and capillary plates are closely spaced plates designed to draw water into the pumping chamber.

19 Claims, 6 Drawing Sheets

Fig. 10.
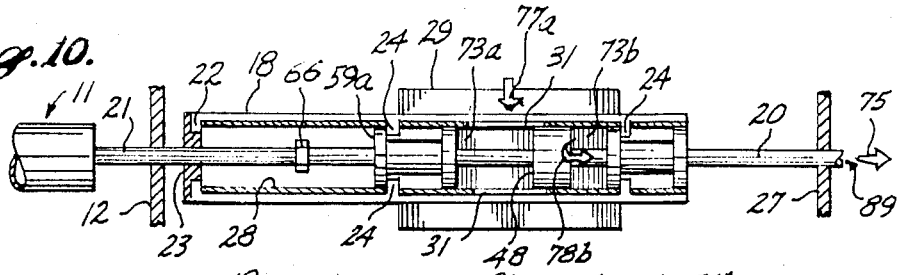
Fig. 11.
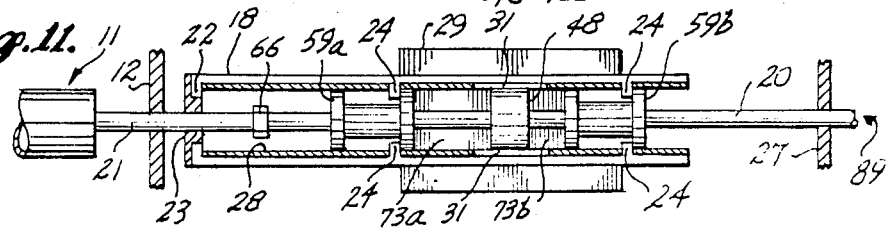
Fig. 12.
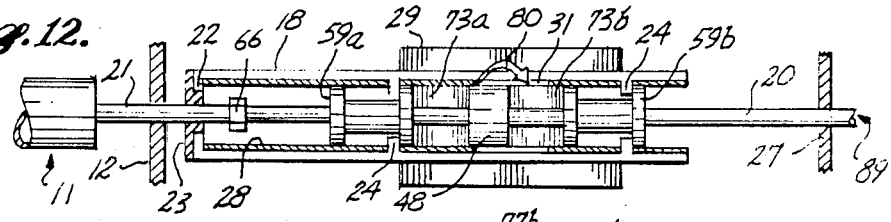
Fig. 13.
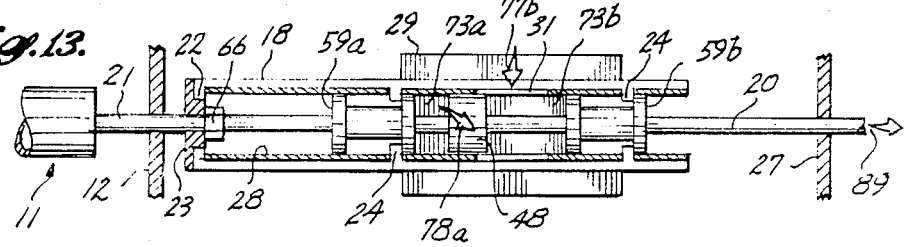
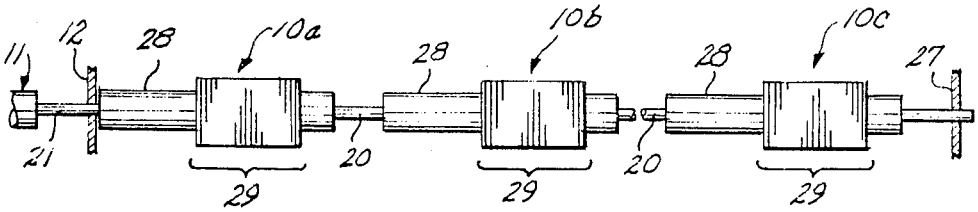
Fig. 14.

CAPILLARY PRIMED PUMP

The government has rights in this invention pursuant to Contract No. NAS9-17302 awarded by the National Aeronautics and Space Administration.

BACKGROUND OF THE INVENTION

The present invention relates to capillary priming of positive displacement pumps in an environment of zero-gravity.

With the advent of space travel, and the building of space stations capable of sustaining human life in zero-gravity conditions, as well as the possibility of actual planetary colonies being founded, many changes must be made in the way conventional mechanical systems are operated. Everyday tasks which are made easier by machines must now be redesigned to assure their operation in zero gravity or near zero-gravity environments.

One important life support function which must be supplied on space stations is heating and cooling. Generally, these heating and cooling systems use the specific heat and the latent heat condensation and the heats of vaporization of fluids to add and remove heat from various areas of the space station.

Fluid transportation is an essential requirement in such heating and cooling systems. Fluids from the condensation of vapors must be moved to areas where they may again gain heat by vaporization. The pumping of fluids in a zero-gravity environment raises special problems due to the lack of any driving force to cause the liquid to fill the pump. On earth, pumping chambers are filled due to the effect of gravity or pressure heads. No such driving force is available in zero-gravity environments.

In positive displacement pumps, a definite volume of liquid is trapped in a chamber, which is alternately filled from an inlet and emptied at higher pressure through a discharge outlet. One example of a type of positive displacement pump uses a reciprocating piston or plunger to supply the necessary displacing force. Liquid is drawn through an inlet port into a cylinder by the withdrawal of the piston and then forced out through a discharge check valve on the return stroke. It is possible to use a piston pump which is double acting, i.e., the liquid is admitted alternately on each side of the piston, so that one part of the cylinder is being filled while the other is being discharged. Further, more detailed discussion of such pumps and their design may be found in *Unit Operations of Chemical Engineering,* 3rd Edition, McCabe, W. L., and Smith J. C., McGraw Hill, 1976, pp. 180–194 and *Chemical Engineers Handbook,* 5th Edition, Perry, R. H. and Chilton, C. H., McGraw Hill, 1973, pp 6-3 to 6-15.

An important step in the operation of a pump involves the introduction of fluid into the pumping chamber prior to displacement (i.e., priming the pump). Under normal conditions found within the earth's atmosphere (i.e., gravitational force, atmospheric pressure and temperature), several driving forces cause the fluid to flow into the pumping chamber. For example, gravity may supply a sufficient driving force to cause the fluid to flow into the chamber. Some type of liquid pressure head on the fluid inlet of the pump, such as submerging the fluid inlet of the pump in a tank of fluid, may cause the pumping chamber to become filled with fluid. Also, the suction force caused by the piston being reciprocated back may be sufficient to draw fluid into the pumping chamber. All of these methods are clearly operable under normal gravitational conditions (i.e., gravitational force on the earth's surface). However, when such pumps are placed in zero-gravity or near zero-gravity conditions, such as on a space station or the moon, severe difficulties arise in attempting to prime the fluid into the pumping chambers.

First, the lack of any gravitational forces rules out the most common driving force for priming the pump. Second, it is difficult to create a pressure head of fluid because to do so it is necessary to have gravity acting on the fluid to create the pressure head. In zero-gravity space applications, it is very possible that many fluids which need to be pumped may be saturated. Therefore, using suction on the fluid suffers from the drawback that the reduced pressure may cause the fluid to vaporize, especially if the fluid is saturated.

Another method of zero-gravity pumping of liquids is to spin the fluid in a centrifuge-type pump, and drain the liquid which accumulates on the periphery of the rotating chamber. However, these pumps suffer from the drawback that they require high speed motion, develop very small pressure heads, and are bulky. Also, at zero-gravity, gases and vapors must be carefully removed from liquid systems in order to pump them reliably with existing pump designs. Since the pumping of liquids will be necessary for space station experiments, utilities, and propulsion equipment, the present design approaches, requiring purging all gases and vapors, will be very maintenance intensive.

It would be desirable to provide a pump for use in zero-gravity conditions which does not suffer from the drawbacks of present day pump designs.

SUMMARY OF THE INVENTION

The present invention provides a positive displacement pump useful for transporting fluids, particularly fluids in a zero-gravity environment. The present invention provides such a pump, that advantageously pumps saturated liquids in zero gravity environments and does not require gravity to prime the pumping chambers. Another advantage realized by using the present invention is the ability to operate a pump that is unaffected by gases and vapors. Finally, the present invention may be used in a pumping system containing several pumping devices with a common driving means, thus allowing for the efficient use of the driving means.

The positive displacement pump includes a fluid accumulator in communication with the fluid to be pumped. The fluid accumulator includes a plurality of closely spaced capillary plates that have a longitudinal bore running therethrough in a direction generally orthogonal to the face of the plates. A sleeve having an exterior surface and an interior surface is positioned in the bore. The capillary plates adjacent the bore are in intimate contact with the exterior surface of the cylindrical sleeve. The sleeve has a plurality of narrow slots that act as fluid inlets that receive fluid from the spaces between the capillary plates. The fluid inlets communicate between the exterior and interior surfaces of the sleeve.

A piston, displacers and capillary plates are mounted on a rod that passes through the center of the sleeve. The rod is mounted for reciprocating movement within the sleeve and has a channel running longitudinally therethrough. A fluid inlet passes through the circumference of the rod and communicates between the exterior of the rod and the channel. First and second displacement members are mounted for sliding on the rod and are spaced from each other.

A piston assembly is affixed to the rod intermediate the first and second displacement members defining first and second variable volume chambers on respective sides of the piston. The piston has a fluid channel therein, placing the ends of the piston in fluid communication with the fluid inlet to the rod. The piston also has a first check valve associated with the fluid channel in the piston allowing fluid from the first variable volume chamber to flow therefrom into the channel of the rod when the first plurality of capillary plates are compressed. The piston also includes a second check valve associated with the fluid channel in the piston that allows fluid from the second variable volume chamber to flow therefrom into the channel of the rod when the second plurality of capillary plates are compressed.

The positive displacement pump also includes a first and second component respectively associated with the sleeve and the first and second displacement members limit the sliding movement of the first and second displacement members between first and second alternate positions.

Each variable volume chamber contains a set of closely spaced capillary plates that are biased a predetermined distance apart. The capillary plates may be compressed toward each other between the piston and the respective displacement member.

Additionally, the positive displacement pump includes a prime mover for reciprocating the rod.

In another embodiment, the prime mover reciprocates the sleeve of the positive displacement pump while the piston and fluid accumulator are fixed. Such embodiment may be particularly useful where the fluid to be pumped does not readily wet the metals from which the pump is manufactured.

Other objects, features and advantages of this invention will be readily apparent from the following description of certain preferred embodiments thereof, taken in conjunction with the accompanying drawings. It is understood that variations and modifications may be effected without departing from the spirit and scope of the novel concepts of the disclosure.

BRIEF DESCRIPTION OF THE DRAWINGS

FIGS. 10–13 illustrate schematic, cross-sectional side views of a pumping sequence of the positive displacement pump in accordance with the present invention where the reciprocating motion is applied directly to the rod.

FIG. 14 illustrates a schematic side view of a series of three positive displacement pumps in accordance with the present invention where a single, rod is common to all three pumps.

DETAILED DESCRIPTION OF THE INVENTION

Figure 1:
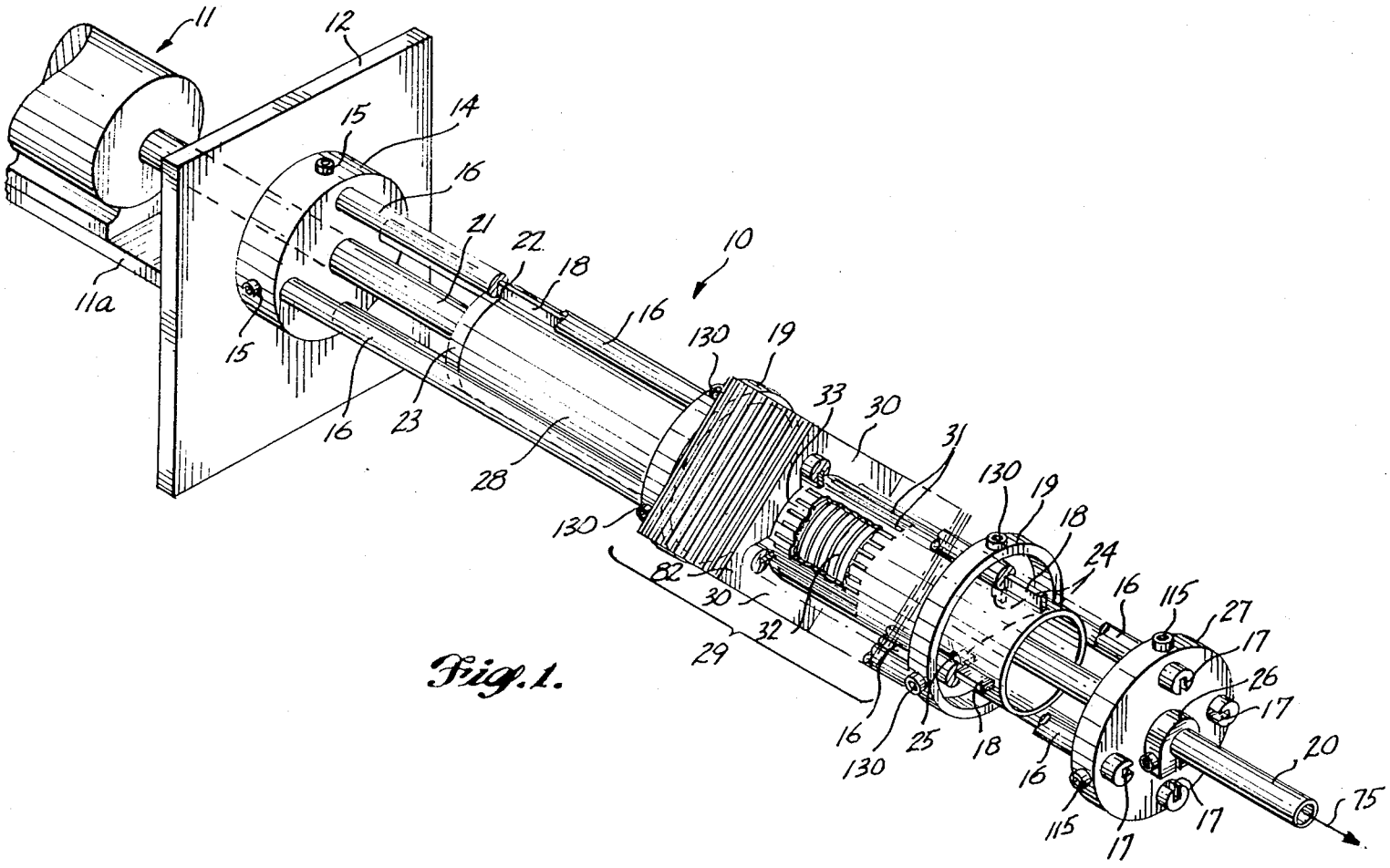
FIG. 1 is an isometric view of the positive displacement pump in accordance with the present invention with a portion of the fluid accumulator, accumulator support rods, and cylindrical sleeve cut away.

As used herein, the term "zero-gravity" is intended to mean zero-gravity or near zero-gravity such as that observed in space or on the moon.

Capillary action is a surface phenomenon that occurs at the boundary between a solid wall and a liquid, or a boundary between a solid and a vapor. The phenomenon is a result of surface films which lie in the boundary between the solid and the fluid. The films are typically only a few molecules thick and associated with each film is an appropriate surface tension. The capillary action is the phenomenon which causes a fluid, such as water, to rise within the interior of a tube that has a portion of it vertically submerged in the water. Capillary action is not restricted to tubes and may occur in different configurations, such as different shaped tubes and vertical parallel walls.

The use of capillary action as a means for moving fluid has only a limited value under normal gravitational forces. The height to which the capillary action will raise a fluid is limited by the competing affect of gravity. However, in zero-gravity conditions, it is possible to move the fluid a larger distance because there is no competing gravitational force exerted on the fluid to be moved. Also, as will be explained further, capillary action is not adversely affected by gas or vapor in the fluid to be transported. In fact, the capillary action serves to rid the fluid of gas and vapor without a maintenance intensive step.

The present invention operates under the principle of capillary action. Closely spaced capillary plates are used to move fluid into the pumping chamber of a positive displacement pump being operated under zero-gravity conditions. Associated with the capillary action is a capillary pressure that is defined as the maximum interfacial pressure difference that a given combination of solid capillary plates and fluid can develop. The capillary pressure is related to the surface tension of the fluid, the contact angle between the fluid and solid, and the effective radius or width of the passageway that the fluid is passing. An example of the interrelationship of the surface tension, contact angle, and effective passageway radius may be illustrated by the following formula:

$$\Delta P = \sigma \cos(\alpha+\theta) \div (W/2) \quad (1)$$

wherein $\Delta P$ = maximum interfacial pressure difference;

$\sigma$ = surface tension of fluid;

$\alpha$ = half angle of the passageway;

$\theta$ = the contact angle of the fluid in relation to the solid boundary;

W = the passageway width.

When the passageway comprises parallel walls of narrowly spaced capillary plates (i.e., $\alpha=0$) the formula reduces to:

$$\Delta P = \frac{2\sigma\cos\theta}{W} \text{ or } W = \frac{2\sigma\cos\theta}{\Delta P} \quad (2)$$

See *University Physics,* Sears, F. W., Zemansky M. W., 2d ed., Addison-Wesley Publishing Company, Inc., 1957, pp. 231–235. Therefore, the capillary pressure is the driving force that causes the fluid to pass between the parallel walls of the capillary plates. As the width between these capillary plates decreases, the capillary pressure (i.e., suction pressure) increases. For a given fluid, it is possible to design a system of closely-spaced capillary plates, dependent upon the capillary pressure ($\Delta P$) desired, that will be capable of moving the fluid in a zero-gravity environment.

The capillary pressure (i.e., suction pressure) that is required to cause fluid to flow into the pumping chambers of a positive displacement pump under normal gravitational conditions is dependent on the type of fluid to be pumped and the distance the fluid must be moved in order to gain access to the pumping chambers. The relationship of such factors under the earth's gravitational force is represented by the formula:

$$\Delta P = \alpha \Delta h \quad (3)$$

wherein:

$\alpha$ = the specific gravity of the fluid to be pumped;

$\Delta h$ = the height the fluid is to be transported in order to fill the pumping chamber; and $\Delta P$ = the pressure required to move the fluid the distance $\Delta h$.

Under conditions of zero-gravity, the distance that the fluid is to be moved is not a critical factor in determining the desired suction pressure because the opposing gravitational force is absent. Rather, a more important factor is the prevention of vaporization of the fluid to be pumped. This factor is especially important when the fluid being pumped is a saturated fluid. Therefore, the maximum suction pressure that a given design of capillary plates may exert on the fluid is preferably less than the pressure that the liquid will vaporize. Vaporization of the fluid is undesirable because of the detrimental effect the presence of vapor has on the wicking action of the capillary plates.

Many fluids are known to exhibit this capillary phenomenon. The present invention is not intended to be limited to any specific fluid systems. However, examples of suitable fluids include water, ammonium systems, liquid fluid propellant systems, and the like. Especially preferred fluids are those which are necessary for the operation of space stations and space travel experiments, utilities, propulsion equipment and microgravity experiments. Preferably, the fluids are either free of entrained gases or saturated under the conditions that the fluid is to be pumped. The fluid to be pumped is preferably saturated so that any vapor bubbles that may form in the capillary plates will collapse. The saturated liquid state causes the bubbles to collapse because the closely spaced plates force any vapor voids to exhibit small radii of curvature. The surface tension on the liquid interfaces increases the bubbles internal pressure and thus due to the vapor-liquid equilibrium, the vapor phase returns to the liquid phase. That is, the vapor pressure is not sufficient to prevent the bubble from collapsing.

Likewise, the types of materials that may be used as the solid boundaries forming the capillary plates is not critical to the present invention. Any type of elastic solid materials that are noncorrosive and compatible with the fluid to be pumped in the operation of space stations or space travel, under zero-gravity conditions, would be appropriate for the practice of the present invention. Examples of such materials include, titanium, nickel, copper, and their alloys and stainless steel. Although the choice of a particular fluid or a particular solid material is not critical, the interaction of the fluid and the solid material must be such that an adhesive force is present between the fluid and the solid boundary. The relationship of the solid and the fluid must be such that at the conditions of use the fluid and solid exhibit a satisfactory contact angle $\theta$. Titanium and water, for example, exhibit a contact angle of about 60°.

The following description of the present invention with relationship to the attached drawings will more clearly illustrate the practice and operation of several embodiments of the present invention.

Figure 2:
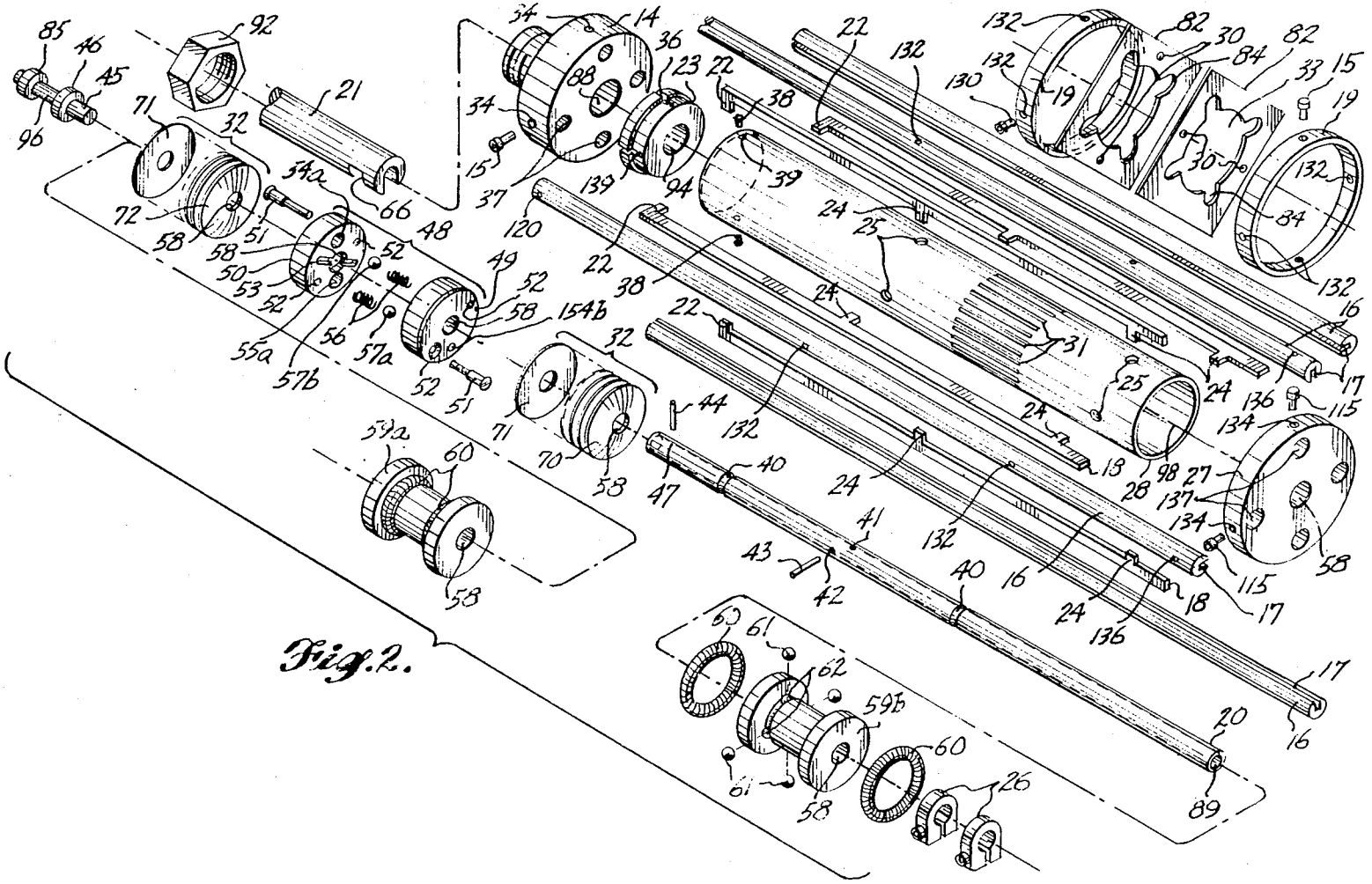
FIG. 2 illustrates an isometric exploded view of the component parts of the positive displacement pump in accordance with the present invention.
Figure 3:
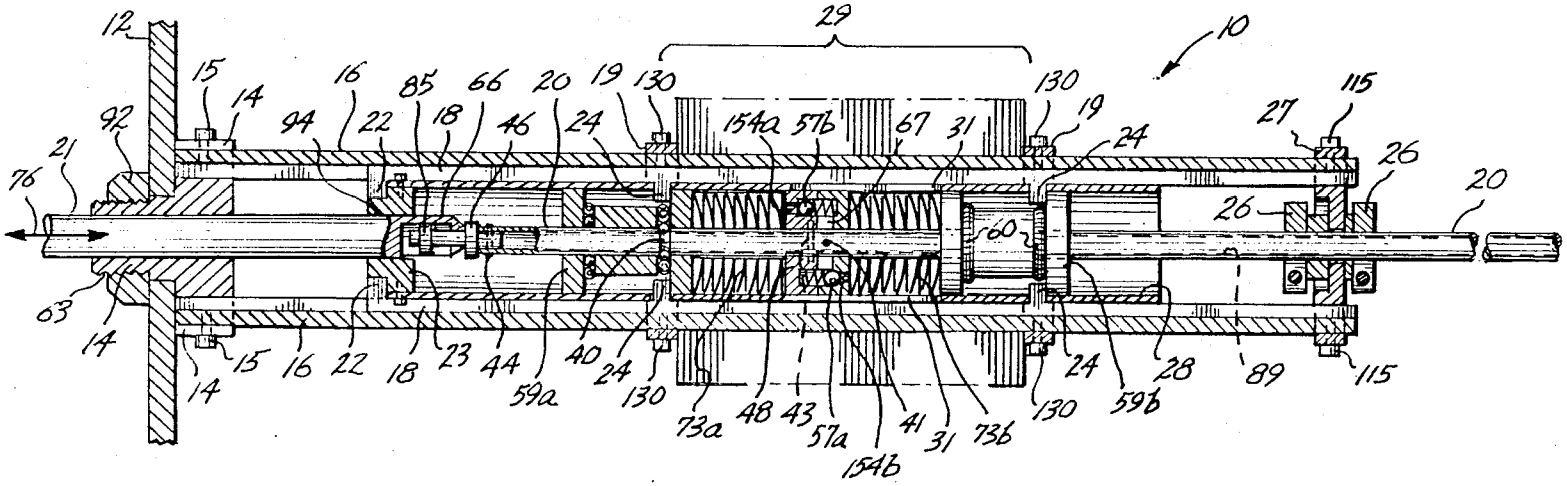
FIG. 3 illustrates a cross-sectional, side view of the positive displacement pump in accordance with the present invention.

Referring to FIGS. 1, 2 and 3, the positive displacement pump 10 constructed in accordance with the present invention is mounted on a suitable bulkhead 12 by a circular retaining ring 14. The pump 10 has been rotated 45° to better illustrate the present invention. Additionally, referring to FIG. 9, in operation the pump 10 will be rotated 45° from the position of FIGS. 1 and 2. The bulkhead 12 has a threaded bore passing therethrough that cooperates with a threaded portion 63 of the retaining ring 14 to secure the retaining ring 14 to the bulkhead 12. The threaded portion 63 of the retaining ring 14 is positioned opposite the face of the retaining ring 14 that accumulator support rods 16 are mounted. As the threaded portion 63 is threaded into the bulkhead 12, the retaining ring 14 becomes securely fastened to the bulkhead 12, thus providing a secure base for the accumulator support rods 16. A portion of the threaded portion 63 of the retaining ring 14 extends through the bulkhead and is secured by a retaining nut 92. The face of the retaining ring 14 opposite the threaded portion 63 has four holes 37 spaced equidistance from each other near the circumference of the plate for receiving four tubular accumulator support rods 16. The longitudinal accumulator support rods 16 are positioned orthogonal to the face of the bulkhead 12 and face of the retaining ring 14. The accumulator support rods 16 have an outer diameter that closely fits into the holes 37 of the retaining ring 14. Threaded holes 34 for threaded set screws 15 pass through the circumference of the retaining ring 14 and communicate between the exterior of the retaining ring 14 and the holes 37. The set screws 15, when threaded through the holes 34 secure the accumulator support rods 16 by mating with the threaded holes 120 in the surface of the accumulator support rods 16 inside the holes 37 of the retaining ring 14.

The retaining ring 14, including the threaded portion 63, has a cylindrical bore 88 passing therethrough in a direction orthogonal to the face of the retaining ring 14. The cylindrical bore 88 has dimensions that allow a drive shaft 21 to pass therethrough. The end of the drive shaft 21 on the side of the bulkhead opposite the face of the retaining ring 14 is connected to a prime mover in the form of a reciprocator 11. The reciprocator 11 is maintained by a mounting plate 11A. The reciprocator 11 can be, for example, a double-acting solenoid for other suitable devices. The drive shaft 21 passes through the bore 88 of the retaining ring 14, thus allowing the reciprocator 11 to communicate with the side of the bulkhead 12 that the retaining ring 14 is secured.

Still referring to FIGS. 1, 2, and 3 the tubular accumulator support rods 16 have a longitudinal track 17 passing therethrough. The longitudinal track 17 passes through the support rods 16 on the side opposite the side that the set screws 15 secure the support rods 16 to the retaining ring 14. The accumulator support rods 16 are secured within the retaining ring 14 so that the longitudinal tracks 17 are positioned on the interior of the support rods 16. The interior of the support rods 16 is defined by the portion of the support rods 16 closest to the axial centerline 98 of the bore 88 passing through the retaining ring 14. Each of the longitudinal tracks 17 has dimensions for receiving one of four identical cylinder guides 18.

The cylinder guides 18 are thin, rigid, longitudinal members of a length less than the accumulator plate support rods 16. Each of the four cylinder guides 18 includes a head tab 22 on the end closest to the retaining ring 14. The head tabs 22 are positioned so that when the cylinder guides 18 are positioned within the track 17, the head tabs 22 point to the axial centerline 98 of the bore 88 passing through retaining ring 14. Each of the cylinder guides 16 also includes a first and second limit stop 24 positioned intermediate to the end opposite the head tabs 22 and the head tabs 22. The limit stops 24 also point in a direction toward the axial centerline 98 of the bore 88 passing through the retaining ring 14. The head tabs 22 and limit stops 24 are rectangular members that protrude from the body of the cylinder guides 18.

The accumulator support rods 16 containing the cylinder guides 18 are retained and supported on the end opposite the retaining ring 14, by a support rod brace 27. The support rod brace 27 is a circular plate that includes four holes 137 passing therethrough for receiving the ends of the support rods 16 opposite the retaining ring 14. The holes 137 of the support rod brace 27 are positioned in the same manner as the holes 37 in the face of the retaining ring 14, thus allowing for the orthogonal alignment of the support rods 16 in relation to the face of the retaining ring 14 and the faces of the support rod brace 27. The four holes 137 in the support rod brace 27 communicate with threaded holes 134, that cooperate with the set screws 115 to secure the ends of the support rod 16 opposite the retaining ring 14 within the support rod brace 27. The set screws 115 are threaded through holes 134 and become seated in holes 136 of the support rods 16. A bore 58 passes through the center of the support rod brace 27 in a direction orthogonal to the faces of the support rod brace 27. The bores 58 has dimensions that allow a rod 20 to pass therethrough, as will be described hereinafter in further detail.

Referring to FIGS. 1 and 3, the four support rods 16, the retaining ring 14 and the support rod brace 27 define a housing in which is positioned a longitudinal cylindrical sleeve 28. The cylindrical sleeve 28 has a diameter smaller than the diameter of housing defined by the interior edges of the support rods 16. The cylindrical sleeve 28 has a diameter that allows the cylindrical sleeve 28 and the cylinder guides 18 to cooperate in a manner that fastens and supports the cylindrical sleeve 28 within the open housing. Additionally, referring to FIG. 2, the cooperation of the cylinder guides 18, the longitudinal track 17 in the support rods 16, the retaining ring 14 and rod support brace 27 provide an open housing to maintain the length of the cylindrical sleeve in a position orthogonal to the face of the retaining ring 14. The cylindrical sleeve 28 will be described in more detail hereinafter.

Again, referring to FIGS. 1, 2 and 3, the cylindrical sleeve 28 is a longitudinal open-ended member, capped on the end nearest the retaining ring 14 by a cylinder head 23. The cylinder head 23 includes a narrow portion and a thick portion. The narrow portion includes the portion of the cylinder head 23 that fits inside the inner diameter of the cylindrical sleeve 28. The thicker portion of the cylinder head 23 remains external to the interior of the cylindrical sleeve 28 and has an outer diameter equivalent to the outer diameter of the cylindrical sleeve 28, thus providing a smooth external cap on the end of cylindrical sleeve 28 nearest the retaining ring 14. The cylinder head 23 is secured to the cylindrical sleeve 28 by screws 38 passing through the top and the bottom of the cylindrical sleeve 28 through holes 39 in the sleeve 28 and into the holes 139 in the circumference of the narrow portion of the cylinder head 23.

The external thick portion of the cylinder head 23 further includes slots 36 for accepting and retaining the head tabs 22 of the cylinder guides 18. The slots 36 are positioned on the cylinder head 23 so that they remain on the exterior of the cylindrical sleeve 28 when the cylinder head 23 is in place. The slots 36 are positioned around the circumference of the cylinder head 23 in a manner consistent with the orientation of the holes 37 and 137 for the support rods 16 in the retaining ring 14 and the support rod brace 27. The cylindrical sleeve 28 has a diameter that is essentially equivalent to the distance between alternating cylinder guides 18 on the top and bottom or on opposite sides of the cylindrical sleeve 23, thus allowing the cylinder guides 18, head tabs 22, and slots 36 to support the cylindrical sleeve 28 within the open housing.

Referring to FIGS. 2 and 3, a bore 94 passes through the center of the cylinder head 23 in a direction orthogonal to the faces of the cylindrical head 23, thus allowing the interior of the cylindrical sleeve 28 to communicate with the exterior of the cylindrical sleeve 28 after the cylinder head is secured in the cylindrical sleeve 28. The bore 94 has dimensions that allow the drive shaft 21 to pass therethrough into the interior of the cylindrical sleeve 28.

Still, referring to FIG. 2, the cylindrical sleeve 28 also includes a first and a second set of limit stop openings 25 positioned intermediate to the end of the cylindrical sleeve 28 containing the cylinder head 23 and the opposite end of the cylindrical sleeve 28. Each set of limit stop openings 25 pass through the cylindrical sleeve 28 and are positioned so that when the head tabs 22 are retained in the slots 36 of the cylindrical head 23 the limit stop openings 25 are adjacent to the respective limit stops 24 of the cylinder guides 18. The limit stop openings 25 allow the limit stops 24 to pass through and engage the circumference of the cylindrical sleeve 28. The limit stops 24 pass through and extend into the interior of the cylindrical sleeve 28 via the limit stop openings 25. The limit stop openings 25 provide additional support for securing the cylindrical sleeve 28 within the open housing created between the support rods 16 and cylinder guides 18.

A plurality of longitudinal fluid inlets 31 are located intermediate the first and second set of limit stop openings 25. The fluid inlets 31 are narrow longitudinal ports positioned around the circumference of the cylindrical sleeve 28. The inlets 31 are evenly spaced around the circumference of the cylindrical sleeve 28. The fluid inlets 31 communicate between the interior and exterior of the cylindrical sleeve 28.

Referring to FIGS. 1, 2, and 3, the support rods 16 are further supported by a first and second support ring 19. The support rings 19 are circular members with a diameter essentially equivalent to the distance between the exterior surfaces of a pair of alternating support rods 16 on the top and bottom or opposite sides of the cylindrical sleeve 28. The diameter of the support rings 19 allows the support rings 19 to closely fit over and around the four support rods 16. Each support ring 19, when placed around the support rods 16, is aligned with a set of the respective first and second limit stop openings 25. The support rings 19 are secured to the support rods 16 by the cooperation of the threaded holes 132 and the set screws 130. The support rings 19 provide additional support to the support rods 16 to prevent them from buckling or bowing outward.

The support rings 19 also serve as retaining rings for a plurality of identical capillary plates 82 making up the fluid accumulator 29. The support rings 19 prevent the movement of the capillary plates 82 along the full length of the cylindrical sleeve 28. The capillary plates 82 (FIG. 7) are thin, flat, square members that are positioned with the faces of the plates 82 orthogonal to the axial centerline 98 of the cylindrical sleeve 28. A bore 33 passes through the center of the capillary plates 82 in a direction orthogonal to the face of the capillary plates 82, thus allowing the cylindrical sleeve 28 to pass closely through the plurality of the capillary plates 82. The capillary plates 82 also include openings 84 that communicate with the bore 33 that allow the support rods 16 to also pass through and, thus, support the capillary plates 82. The openings 84 are positioned on the circumference of the bore 33 in a manner similar to the position of the holes 37 and 137 in the retaining ring 14 and the support rod brace 27. The bore 33 through the capillary plates 82 has a diameter substantially equivalent to the external diameter of the cylindrical sleeve 28, thus providing intimate contact between the external surface of the cylindrical sleeve 28 and the interior portions of the capillary plates 82 defining the bore 33.

Figures 4, 5, 6, 7, 9:
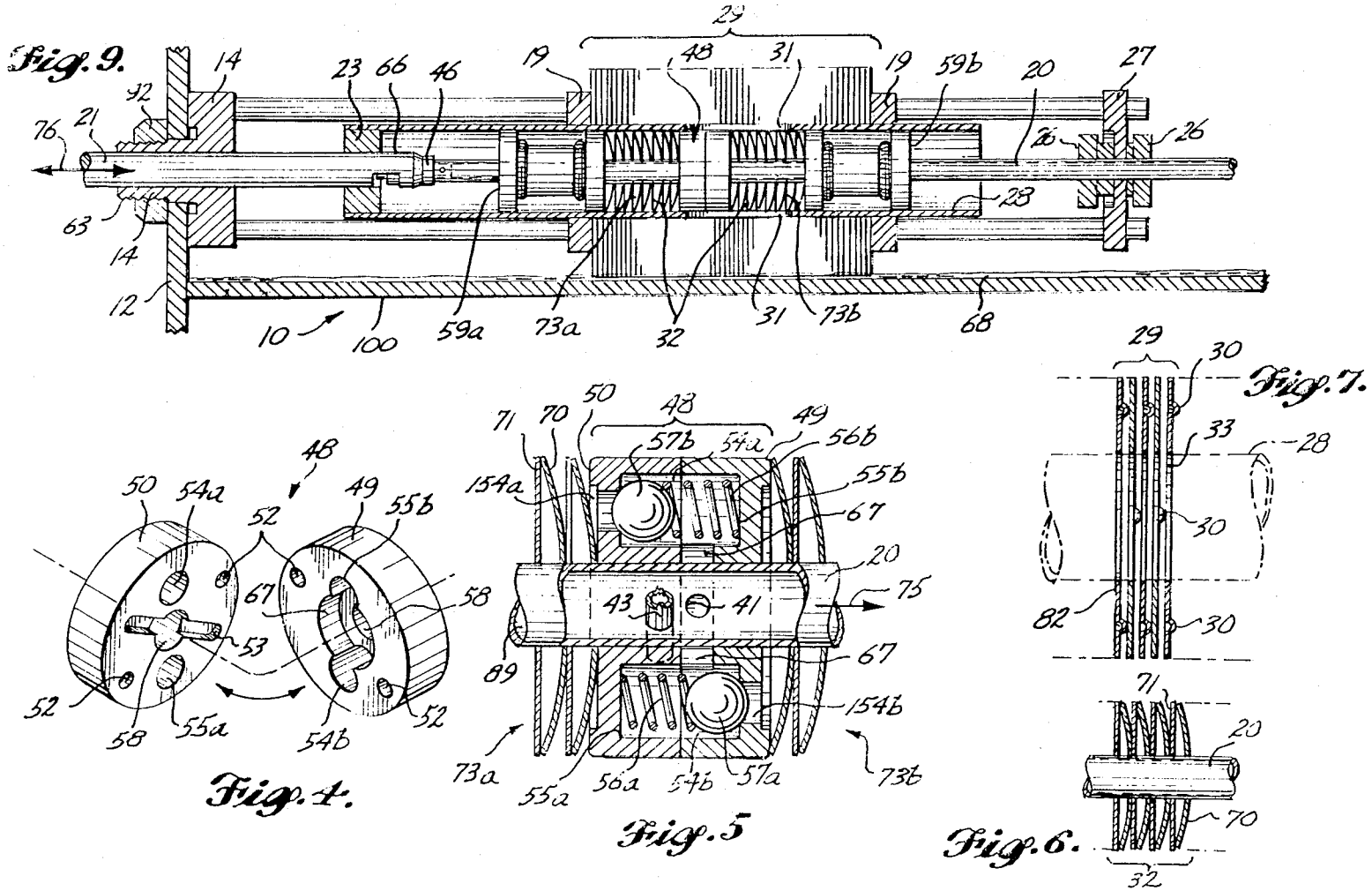
FIG. 4 illustrates a detailed, isometric view of the left-hand side of the piston assembly and a detailed, isometric view of the right-hand half, rotated 90° of the piston assembly of the positive displacement pump in accordance with the present invention.
FIG. 5 illustrates a detailed, cross-sectional side view of the piston assembly of the positive displacement pump in accordance with the present invention.
FIG. 6 illustrates a detailed, cross-sectional side view of the capillary plates contained within the pumping chambers of the positive displacement pump in accordance with the present invention.
FIG. 7 illustrates a detailed, environmental, side view of the capillary plates of the fluid accumulator used in the positive displacement pump in accordance with the present invention.
FIG. 9 illustrates a cross-sectional environmental view of the positive displacement pump in accordance with the present invention.

Still referring to FIGS. 1, 2 and 7, each capillary plate 82 includes a first and second dimple 30 protruding from one face of the capillary plate 82. The first and second dimples are centered on opposite sides of the bore 33 passing through the capillary plates 82. Because the openings 84 for the support rods 16 are positioned adjacent to the four corners of the square capillary plates 82 on the circumference of the bore 33 the capillary plates 82 may be mounted in a first or second alternative position. Specifically, referring to FIG. 7, the first position is defined by the dimples 30 being respectively positioned above and below the cylindrical sleeve 28. The second position is defined by the first and second dimples 30 being on opposite sides of the cylindrical sleeve 28. The identical capillary plates may be shifted from the first position to the second position by rotating the plate 90° around its center from its original position. Therefore, an adjacent capillary plates 82 and dimples 30 are preferably positioned in a position rotated 90° from the dimples 30 on the adjacent plate 82.

A plurality of capillary plates 82 make up the fluid accumulator 29 (FIGS. 1 and 3). The internal bore 33, through the capillary plates 82, is intimately contacting the fluid inlets 31 and the exterior of the cylindrical sleeve 28. The capillary plates 82 are biased apart a distance that allows fluid to be pumped to wick within the space between the capillary plates 82 to the interior bore 33. The spacing between the capillary plates 82 is provided by the first and second dimples 30 protruding from the face of each capillary plate 82 as discussed above. The dimples 30 protrude from the same surface of the capillary plates 82 and are in the first and second alternate positions on adjacent capillary plates 82. The alternating first and second positions of the dimples 30 results in the dimples 30 being placed against the side of the adjacent capillary plates 82, that does not have the dimples 30 on its surface, thus resulting in alternating edges of the capillary plates being biased apart a distance determined by the size of the dimples 30. Preferably, where the saturated fluid to be pumped is water, the bias between adjacent capillary plates 82 of the fluid accumulator 29 ranges from about 0.01 inches to about 0.025 inches, most preferably from about 0.014 inches to about 0.018 inches.

The fluid accumulator 29 viewed from its exterior (FIG. 1), includes the edges of the capillary plate 82, spaced apart by small gaps for capillary liquid flow. In application, the surface formed by the edges of the capillary plate 29 is shaped to conform with a portion of the active condensing wall (100 in FIG. 9) of a heat exchanger, or the inner wall of a liquid storage tank. The wall 100 is provided with laterally disposed capillary transport means, such as closely spaced grooves, fine mesh screens, or a porous surface finish. The transport mechanism accumulates and carries liquid from the working environment to the fluid accumulator in a zero gravity environment.

Now, referring primarily to FIGS. 1, 2 and 3, a rod 20 has been removed from the interior of the cylindrical sleeve 28 (FIG. 2). The rod 20 is a longitudinal tube with an internal channel 89 passing longitudinally therethrough for fluid flow in the direction of arrow 75. The rod 20 has an outer diameter that allows it to be mounted for sliding within the bore 58 of the support rod brace 27. The rod 20 is longitudinally disposed in the center of the cylindrical sleeve 28 and supported on the end opposite the bulkhead 12 by the cooperation between the rod 20 and the bore 58 through the center of the support rod brace 27 (FIGS. 1 and 3). The rod 20 passes through the bore 58 in a direction orthogonal to the faces of the support rod brace 27. In the embodiment where the piston assembly 48 and rod 20 are reciprocated, the clamps 26 are removed or are of the type that allow the rod 20 to slidably pass therein as well as through the bore 58 as indicated by arrow 76. In the embodiment (FIG. 8) where the cylindrical sleeve 28 is reciprocated while the piston assembly 48 is fixed, the rod 20 is secured to the support rod brace 27 by conventional means such as a clamp 26 on both sides of the support rod brace 27.

Referring to FIGS. 2 and 3, the rod 20 further includes a first and second retaining detents 40 positioned so that the detents 40 may be aligned with the respective first and second set of limit stops 24 and limit stop openings 25 when the rod 20 is positioned within the cylindrical sleeve 28. The retaining detents 40 are narrow channels that have been machined into the circumference of the rod 20. A pinhole 42 is positioned intermediate the first and second retaining detents 40, and passes through the sides of the rod 20. The pinhole 42 has dimensions that allow a piston pin 43 to pass therethrough and be retained in the rod 20. The piston pin 43 has a length greater than the outer diameter of the rod 20, thus the piston pin 43 protrudes from the sides of the rod 20. Adjacent to the pinhole 42, located on top of the pushrod 20, is a fluid inlet 41 that allows the internal channel 89 through the rod 20 to communicate with the exterior of the rod 20. The fluid inlet 41 is slightly further removed from the end of the rod 20 closest the retaining ring 14 than the piston pin hole 42. The piston pin hole 42 and the fluid inlet 41 are positioned orthogonal to each other.

The rod 20 on the end nearest the bulkhead 12 and retaining ring 14 is capped by a rod cap 46. The rod cap 46 includes a circular plate that has a diameter smaller than the internal diameter of the cylindrical sleeve 28, thus allowing the rod cap 46 to pass through the cylindrical sleeve 28. Centered on the surface of the circular plate opposite the bulkhead 12 is a plug portion having a diameter that fits closely within the internal channel 89 of the rod 20. The plug portion has a diameter smaller than the circular plate of the rod cap 46. The plug portion extends from the face of the circular plate in a direction orthogonal to the face of the circular plate. The plug portion of the rod cap 46 caps the internal channel 89 of the rod 20 on the end closest to the bulkhead 12. The plug portion of the rod cap 46 is secured within the internal channel 89 by the cooperation between a pin 44 and a pinhole 47 in the top and bottom of the rod 20 that allows the pin 44 to pass through a pinhole 45 in the plug portion. On the side of the rod cap 46 opposite the plug portion is centered a coupling head 85. In the embodiment of the pump wherein the cylindrical sleeve 28 is reciprocated while the rod 20 and piston assembly 48 are stationary the rod cap 46 is as described above. However, in the embodiment where the rod 20 and piston assembly 48 are reciprocated while the cylindrical sleeve 28 is fixed the rod cap 46 includes a coupling head 85 as described below.

The coupling head 85 is a circular member of diameter less than the internal diameter of the cylindrical sleeve 28. The coupling head 85 includes a circular plate connected to the rod cap 46 on the side closest to the retaining ring 14 by a cylindrical shaft 96 that is centered on both the circular plate of the coupling head 85 and the circular plate of the rod cap 46. The cylindrical shaft 96 is a machined shaft of diameter essentially equivalent to the plug portion of the rod cap 46. The rod cap 46 and the coupling head 85 share the same axial centerline and are concentrically positioned in relation to each other. The cylindrical shaft connects the center of the circular plate of the coupling head 85 and the rod 46. The coupling head 85, when positioned within the cylindrical sleeve 28, cooperates with a drive shaft coupling 66 in a manner that connects the rod 20 with the reciprocator 11, as will be dicussed further hereinafter in relationship to FIG. 3. The coupling head 85 provides the connection to the reciprocator 11 that allows the rod 20 to be reciprocated while the sleeve 28 is fixed.

The drive shaft 21 is removed from the bore 88 and the bore 94 through the respective retaining ring 14 and the cylinder head 23 (FIG. 2). The drive shaft 21 on the end opposite the reciprocator 11 has a drive shaft coupling 66. The drive shaft coupling 66 is constructed so that it will engage the cylindrical shaft 96 between the circular plate of the coupling head 85 and the circular plate of the rod cap 46. The drive shaft coupling 66 and the cylindrical shaft 96 engage each other inside the cylindrical sleeve 28 just inside the cylinder head 23 (FIG. 3). The drive shaft coupling 66 is placed inside the cylindrical sleeve 28 by passing the drive shaft 21 through the bore 94 of the cylinder head 23. When the drive shaft coupling 66 cooperates with the cylindrical shaft 96 and circular plate of the coupling head 85, the rod 20 may be reciprocated by the reciprocator 11 while the cylindrical sleeve 28 remains fixed.

A first and second displacer 59A and 59B are positioned directly over the retaining detents 40 (FIG. 3). Referring to FIG. 2, the first and second displacers **59*a* and 59*b* have been removed from the rod 20. The displacers include circular flanges on opposite ends of the displacers with the flanges connected by an interior cylindrical neck. The diameter of the cylindrical flanges on the ends of the displacers 59*a* and 59*b* is substantially equivalent to the internal diameter of the cylindrical sleeve 28, thus allowing for the slidable movement of the displacers within the cylindrical sleeve 28 in a direction parallel with the axial centerline 98 of the cylindrical sleeve 28. The cylindrical neck that connects the cylindrical flanges of the displacers 59*a* and 59*b*** is of a smaller diameter than the circular flanges.

A bore 58 passes through the center of the circular flanges and cylindrical neck of the displacers **59*a* and 59*b* in a direction orthogonal to the face of the flanges. The bore 58 has a diameter substantially equivalent to the outer diameter of the rod 20, thus allowing the displacers 59*a* and 59*b* to be mounted onto the rod 20 for sliding motion. When the displacers 59*a* and 59*b* are mounted on the rod 20 and the rod mounted in the cylindrical sleeve 28, the faces of the flanges are perpendicular to the axial centerline 98 of the cylindrical sleeve 28. Each displacer at the junction of each circular flange and the cylindrical neck include four holes 62 in the cylindrical neck that allow the bore 58** to communicate with the exterior of the cylindrical neck.

The holes 62 are positioned at 90° in relation to each other around the circumference of the cylindrical neck. The diameter of the holes 62 narrows from the exterior of the cylindrical neck to the interior bore 58. The holes 62 are constructed so that ball bearings 61 may partially communicate with the interior bore 58 and become seated in the retaining detents 40. The diameter of the holes 62 at the interior of the displacers **59*a* and 59*b* must be large enough to allow a portion of the ball-bearings 61 to extend into the bore 58 thus engaging the retaining detent 40 when the detent 40 and the ball bearings 61 are aligned. When the ball bearing 61 and detent 40 are not aligned, the ball bearings are forced back into the holes 62. Springs 60 encompass the holes 62 and ball bearings 60 and bear inwardly upon the ball bearings 61 forcing the ball bearings 61 to engage the retaining detent 40 when the holes 61 and the retaining detent 40** are aligned.

Referring to FIGS. 3 and 5, the piston assembly 48 is positioned intermediate to the displacers 59*a* and 59*b* directly over the fluid inlet 41 of the rod 20. Additionally, referring to FIGS. 2 and 4, the piston assembly 48 has been removed from the rod 20. The piston assembly 48 includes a left half 50 and a right half 49 (FIGS. 2 and 4) that cooperate with the piston pin 43 to secure the piston assembly 48 to the rod 20 as will be discussed in more detail with reference to FIG. 5. A bore 58 passes through the center of both the left half 50 and right half 49 of the piston assembly 48 in a direction orthogonal to the ends of the piston assembly 48, thus allowing the piston assembly 48 to be mounted onto the exterior of the rod 20 (FIGS. 3 and 5). When the piston assembly 48 is mounted on the rod 20, the ends of the piston assembly 48 are orthogonal to the axial centerline of the cylindrical sleeve 28. The left half 50 and right half 49 of the piston assembly 48 are circular members that have an outer diameter substantially equivalent to the internal diameter of the cylindrical sleeve 28, thus allowing for the sliding movement of the piston assembly 48 within the cylindrical sleeve 28. The two halves of the piston assembly 48 are held together by two piston screws 51. The left half 50 and right half 49 of the piston assembly 48 are constructed with passageways that allow the exterior ends of the piston assembly 48 to communicate with the internal channel 89 of the push-rod 20 by way of the fluid inlet 41 in the rod 20. A more detailed description of the passageway within the piston assembly 48 will be described with reference to FIGS. 4 and 5.

In the interior face of the left half 50 of the piston assembly 48, a piston pin retainer 53 is countersunk into the inner face (FIGS. 2 and 4). The piston pin retainer 53 passes orthogonally through the axial centerline of the bore 58 passing through the center of the piston assembly 48. The piston pin retainer 53 has dimensions that will accept and retain the piston pin 43 positioned in the rod 20. The cooperation between the piston pin retainer 53, the right half 49 of the piston assembly 48, and the piston pin 43 secure the piston assembly 48 to the rod 20. The left half 50 and the right half 49 of the piston assembly 48 are held together by first and second piston retaining screws 51. Each piston half 50 and 49 has a first and second piston screw holes 52 passing through the ends of the piston halves that are threaded and cooperate with the piston retaining screws 51 to fasten together the left half 50 and right half 49 of the piston assembly 48. The piston screw holes 52 pass through both halves of the piston assembly 48 in a direction orthogonal to the ends of the piston assembly 48 and are located near the circumference of the piston assembly 48. The first and second piston screw holes 52 in each piston half 49 and 50 are positioned 180° from each other on opposite sides of the bore 58 passing through the piston assembly 48.

The left half 50 and right half 49 of the piston assembly 48 are fastened together by the piston retaining screws 51 (FIG. 2). The piston assembly 48 is secured to the rod 20 by the piston pin 43 that is retained inside the interior of the piston assembly 48, within the piston pin retainer 53. The piston assembly 48 has passages throughout the interior of the left half 50 and right half 49 (FIGS. 2 and 4) that allow fluid located on the exterior of the piston assembly 48 to pass through the piston assembly 48 and into the channel 89 of the rod 20 through the fluid inlet 41 of the rod 20.

A circular bore passes orthogonally through the face of the left-hand half of the piston assembly and defines a check valve 54*a* (FIGS. 2, 4 and 5). The bore has a narrower diameter near the outer face of the left half 50 of the piston assembly 48. This narrow diameter bore defines a check valve entry 154*a*. Check valve 54*a* and entry 154*a* are positioned near the circumference of the left half 50 of the piston assembly 48. The check valve 54*a* is positioned around the circumference of the left half 50, 90° in relation to the position of the piston screw holes 52 in the left half 50 of the piston assembly 48. A countersunk bore in the interior face of the left half 50, located near the circumference of the left half 50 of the piston assembly 48, and located around the circumference of the left half 50, 180° in relation to the check valve 54*a*, defines a check valve seat 55*a*. The check valve seat 55*a* does not pass completely through the left-hand half 50 of the piston assembly 48. As will be discussed in more detail with reference to FIG. 5, the check valve 54*a* and check valve seat 55*a* of the left half 50 of the piston assembly 48 cooperate with the right half 49 of the piston assembly 48 to partially define the passageway that allows fluid on the exterior of the piston assembly 48 to communicate with the interior channel 89 of the rod 20.

The right half 49 of the piston assembly 48 includes the previously described piston screw holes 52. In the center of the right half 49 of the piston assembly 48 is a circular, countersunk fluid cavity 67 that communicates directly with a check valve 54*b* and a check valve seat 55*b* that are located within the right half of the piston assembly (FIGS. 2, 4 and 5). The check valve 54*b* is a circular bore that passes orthogonally through the face of the right half 49 of the piston assembly 48. The bore has a narrower diameter near the exterior face of the right half 49 of the piston assembly 48. This narrow portion defines a check valve entry 154*b*. The check valve seat 55*b* is a countersunk, orthogonal bore in the interior face of the right half 50 that does not pass completely through the right half 50 of the piston assembly 48. The check valve 54*b* and entry 154*b* in the right half 49 of the piston assembly 48 are positioned so that when the two halves right half 49 is directly aligned with the check valve seat 55*a* of the left half 50 of the piston assembly 48. Likewise, the check valve seat 55*b* of the right half 49 of the piston assembly 48 aligns directly with the check valve 54*a* of the left half 50 of the piston assembly 48.

The bores that define the check valve seat 55*b* and the check valve 54*b* in the right half 49 of the piston assembly 48 directly communicate with the circumference of the countersunk fluid cavity 67 in the inner face of the right half 49 of the piston assembly 48. When the left half 50 and the right half 49 of the piston assembly 48 are fastened together by the piston retaining screws 51, the external right face of the piston assembly 48 may communicate with the interior fluid cavity 67 through the check valve 54*b* and entry 154*b* in the right half 49 of the piston assembly 48. Likewise, the exterior left half 50 face of the piston assembly 48 also communicates with the interior fluid cavity 67 through the check valve 54*a* and entry 154*a*.

Referring primarily to FIGS. 2 and 5, the piston assembly 48 further includes a pair of check valve springs 56*a* and 56*b* and a pair of check valve ball bearings 57*a* and 57*b*. Each check valve spring 56 is seated within the check valve seat 55 in the respective half of the piston assembly 48. The bottom of the check valve seat 55*a* serves as the support base for the check valve spring 56*a* and the bottom of the check valve seat 55*b* serves as the support base for the check valve spring 56*b*. On top of the check valve spring 56*a* is positioned the check valve ball bearing 57*a* that has a diameter slightly less than the diameter of the check valve seat 55*a* and the check valve 54*b*. However, the ball bearing 57*a* has a diameter that is larger than the diameter of the check valve entry 154*b*, thus retaining the ball-bearing 57*a* within the check valve inlet 54*b*. Thus, the check valve spring 56*a* supports the check valve ball bearing 57*a* in the check valve entry 154*b* against the check valve fluid entry 154*b* and provides a resistive force in the direction opposite to the direction that the fluid will enter the check valve entry 154*b*. The check valve 54*a*, check valve entry 154*a*, ball-bearing 57*b*, spring 56*b* and check valve seat 55*b* cooperate in a similar manner.

Additionally, referring primarily to FIG. 3, the left half 50 and right half 49 of the piston assembly 48 is securely fastened to the rod 20 by the cooperation of the piston pin 43 and the piston pin retainer 53. The cooperation of the piston pin 43 and the piston pin retainer 54 allows the fluid inlet 41 to be positioned in direct fluid communication with the fluid cavity 67 within the piston assembly 48. The fluid communication allows fluid that enters the fluid cavity 67 to pass through the fluid inlet 41 into the internal channel 89 of the rod 20. Fluid enters the fluid cavity 67 by passing through either of the check valve entry passages 154*a* or *b* and compressing the spring 154*a* or *b* in the direction of the fluid flow, thus removing the check valve ball bearing 57*a* or *b* from the check valve entry 154*a* or *b*. The operation of the piston assembly 48 in cooperation with the other components of the present invention will be described hereinafter in more detail, particularly with reference to FIGS. 3, 9 and 10–18.

The capillary plates 32 have been removed from the rod 20 (FIG. 2). A bore 58 passes through the center of the capillary plates 32 in a direction orthogonal to the face of the capillary plates 32, thus allowing the capillary plates 32 to be mounted onto the rod 20 (FIGS. 3 and 6). The surface of the plates 32 are essentially orthogonal to the axial centerline of the rod 20. The capillary plates 32 include circular alternating flat plates 71 and concave plates 70. The capillary plates 32 have an outer diameter essentially equivalent to the inner diameter of the cylindrical sleeve 28. The bias between the alternating flat 71 and concave plates 70 provides the spacing that is necessary to promote the wicking of fluid between the capillary plates 32. Preferably, where the fluid to be pumped is saturated with water, the bias between adjacent capillary plates ranges from about 0.01 inches to about 0.025 inches, most preferably from about 0.014 inches to about 0.018 inches. The capillary plates 32 are constructed of a material that allows for the compression and expansion of the stack of capillary plates 32. Preferably, the material is a metal such as titanium. The concave nature of the concave capillary plates 70 allows for the design of the space between the capillary plates 32 to be sufficient to wick the fluid to be pumped from the fluid inlets 31 in the cylindrical sleeve 28 to a first or second pumping chamber 73*a* or 73*b* of the positive displacement pump 10 (FIG. 3). The first and second pumping chambers 73*a* and 73*b* are defined by the inner faces of the displacers 59*a* and 59*b* and the ends of the piston assembly 48 within the cylindrical sleeve 28. The fluid that is wicked into the pumping chambers 73*a* or 73*b* by the capillary plates 71 and 70 is in fluid communication with the interior channel 89 of the pushrod 20 by way of the passages within the piston assembly 48 as described hereinbefore with relation to the piston assembly 48 and the fluid inlet 41 of the rod 20. Thus, fluid that is present in the pumping chambers 73*a* or 73*b* will exit the pumping chambers 73*a* and 73*b* through the interior channel 89 by way of the fluid inlet 41 in the rod 20. One set of capillary plates 32 is positioned intermediate the piston assembly 48 and the displacer 59*a* and a second set of capillary plates 32 are intermediate the piston assembly 48 and the displacer 59*b*.

The rod 20 with the displacers 59*a* and 59*b*, the capillary plates 32, the piston assembly 48, and the rod cap 45 with the coupling head 85 in position is mounted for sliding in the interior of the cylindrical sleeve 28. The rod is supported within the interior of the cylindrical sleeve by the cooperation of the bore 58 passing through the displacers 59*a* and 59*b*, the capillary plates 32, and the piston assembly 48 and the drive shaft coupling 66.

Figure 8:
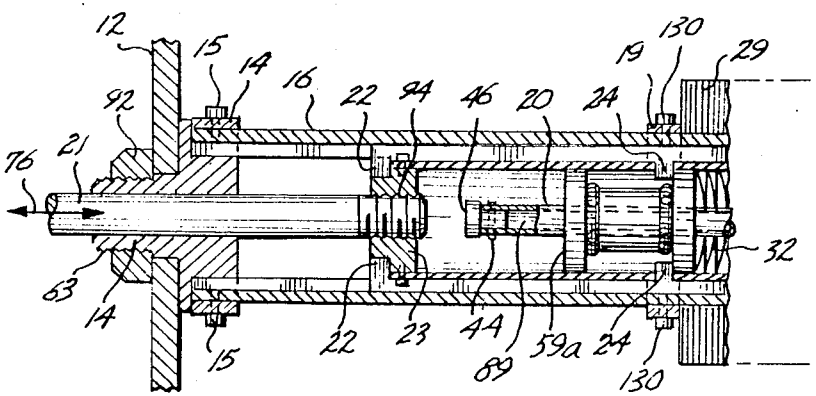
FIG. 8 illustrates a cross-sectional side view of the positive displacement pump in accordance with the present invention.

Referring now to FIG. 8, in an alternative embodiment wherein the sleeve 28 is reciprocated and the piston assembly 48 and rod 20 are fixed, the drive shaft 21 passes orthogonally through the bulkhead 12 and retaining ring 14 (FIGS. 2 and 3). The drive shaft 21 on the end that is opposite the reciprocator 11 includes a threaded portion. In this embodiment, the bore 94 (FIG. 2) through the cylinder head 23 has threads (not shown) that cooperate with the threads of the drive shaft 21 to secure the threaded portion of the drive shaft 21 to the cylinder head 23. Since the cylinder head 23 is fastened to the cylindrical sleeve 28, the reciprocator 11 reciprocates the cylindrical sleeve 28, rather than the rod 20 (FIG. 3).

Referring to FIG. 9, the pump assembly 10 has been rotated 45° around the axial centerline of the cylindrical sleeve 28. This places a full edge of the capillary plates 82 of the fluid accumulator 29 in the fluid 68 to be pumped. As discussed hereinbefore, FIGS. 1, 2, 3, 4, 8, 10–13, and 15–18, have been rotated 45° from the position in which the pump 10 would be preferably operated, to enhance the illustration of the components of the present invention.

The pump assembly 10 as described hereinabove is preferably operated under conditions of zero gravity. The operation of the pump assembly will be discussed hereinafter with reference to FIGS. 10–13 and 15–18 that sequentially illustrate the pump assembly 10 going through a pumping cycle.

Referring to FIGS. 10–13, the reciprocating drive shaft 21 is directly connected to the rod 20 by the rod coupler 66 as discussed in more detail hereinbefore with reference to FIGS. 2 and 3. The support rods 16 are not illustrated in order to simplify the schematic illustration. The reciprocator 11 reciprocates the rod 20 while the cylindrical sleeve 28 remains stationary because of the interaction of the cylindrical sleeve 28 and the cylinder guides 16. In FIG. 10 the pumping chamber 73*b* has been compressed between the displacer 59*b* and the piston assembly 48 and the fluid therein has passed into the interior channel 89 of the rod 20 through the internal fluid channels of the piston assembly 48 as indicated by the arrow 78*b*. The fluid exits the rod 20 as indicated by arrow 75. The pumping chamber 73*b* has been compressed by the movement of the rod 20 and piston assembly 48 in a direction away from the retaining ring 14 and toward the displacer 59*b*. A more detailed description of the flow of fluid through the internal channels of the piston assembly 4 has been given hereinbefore with reference to FIGS. 4 and 5.

The capillary plates 32, in the pumping chamber 73*b*, are in a compressed state. The capillary plates 32 in the pumping chamber 73*a* are in an expanded state. In FIG. 10, the pumping chamber 73*b* in the compressed state is no longer in fluid communication with the plurality of fluid inlets 31 in the circumference of the cylindrical sleeve 28. The fluid to be pumped that has wicked between the capillary plates (82 in FIG. 1) of the fluid accumulator 29 to the center bore (33 in FIG. 7) passing orthogonally through the capillary plates containing the cylindrical sleeve 28, will pass through the plurality of fluid inlets 31 in the cylindrical sleeve 28, and be wicked into the pumping chamber 73*a* by the capillary plates (32 in FIG. 9) present in the expanded pumping chamber 73*a*. The direction of flow of the fluid into the pumping chamber 73*a* is indicated by the arrow 77*a* in FIG. 10.

In FIG. 11, the reciprocator 11 has moved the rod 20 to the left as indicated by the change in position of the drive shaft coupling 66. This movement causes the displacers 59*a* and 59*b* to move to the left with regard to the cylindrical sleeve 28 but not with regard to the rod 20. The displacers 59*a* and 59*b* maintain their initial position on the rod 20 because of the cooperation between the first and second set of retaining ball bearings (61 in FIG. 3) and the first and second retaining detents (40 in FIG. 3). The stationary position of the displacers 59*a* and 59*b* in relationship to the rod 20 is changed in FIGS. 11 and 12 as the inside of the right-hand flange of the displacers 59*a* and 59*b* contacts the first and second set of limit stops 24. At this point, the piston assembly 48 that is affixed to the rod 20 and the rod 20 continue to move to the left. The displacers 59*a* and 59*b* are no longer stationary in relation to the rod 20 and the piston assembly 48. As the rod 20 draws the piston assembly 48 further to the left, the pumping chamber 73*b* begins to expand and communicate with the fluid inlets 31 while the pumping chamber 73*a* begins to compress between the displacer 59*a* and the piston assembly 48 and becomes isolated from the fluid inlets 31.

Long fluid inlets 31 of the pump 10 are shown whereby some of the overflow from the initial compression of the pumping chamber 73*a* may be used to mechanically prime the pumping chamber 73*b* by the overflow of fluid from pumping chamber 73*a* to pumping chamber 73*b* as indicated by the arrow 80 in FIG. 2. It is also possible that the fluid inlets 31 may have dimensions that only allow one pumping chamber 73*a* or 73*b* to communicate with the fluid inlets 31 at one time. This will prevent the overflow of fluid from the initial compression of the expanded pumping chamber. Referring to FIG. 12, the reciprocator 11 continues to move the rod 20 and piston assembly 48 to the left until the pumping chamber 73*a* becomes completely isolated from the fluid inlets 31. At this point, the fluid in the pumping chamber 73*a* begins to pass into the check valve inlet (154*a* in FIG. 5) of the piston assembly 48, and enters the interior channel 89 of the rod 20 as indicated by the arrow 78*a* in FIG. 13. The position of the positive displacement pump in FIG. 12 is the same as the position illustrated in FIG. 3.

Referring back to FIG. 5, the compression of the pumping chamber 73*a* causes the check valve spring 56*b* to be compressed, thus allowing the ball bearing 57*b* to disengage the check valve entry 154*a*. As the check valve ball bearing 57*b* disengages the check valve entry 154*a*, the fluid passes through the check valve entry 154*a* and the check valve 54*a* and may enter the fluid cavity 67 that is in direct fluid communication with the interior channel 89 of the rod 20 through the fluid inlet 41. Thus, fluid that enters the check valve 54*a* will be removed from the pumping chamber 73*a* by way of the interior channel 89 of the rod 20. The fluid will enter the check valve 54*a* until the compression of the pumping chamber 73*a* is complete. Once the compression is complete, the reciprocator 11 begins to change direction of the rod 20 and piston assembly 48 and start the pumping cycle over again with the pumping chamber 73*b* now being in expanded form and full of water as indicated by the arrow 77*b* in FIG. 13. The expansion of pumping chamber 73*a* allows the ball bearing 57*b* to engage the check valve entry 154*a*, thus allowing the pumping chamber 73*a* to fill with fluid again. The pumping chamber 73*b* has become full of fluid because of the wicking action of the capillary plates of the fluid accumulator 29 and the wicking action of the capillary plates of the pumping chamber 73*b*. The pumping sequence now begins to proceed over again with pumping chamber 73*b* being compressed.

Referring to FIG. 14, a series of positive displacement pumps 10*a*, 10*b*, and 10*c* are aligned in series with a common longitudinal rod 20 passing through the cylindrical sleeve 28 of each pump. A single prime mover 11 is attached to the rod 20 through the drive shaft 21. Therefore, it is possible to utilize several pumps in series with the requirement of only one reciprocator 11. Each pump 10*a*, 10*b* and 10*c* works independently as discussed hereinbefore, with the exception that each pump is connected to a single reciprocator 11.

Referring to FIGS. 8 and 15–18, the cylindrical sleeve 28 of the positive displacement pump 10 is reciprocated by the reciprocator 11 attached to the cylindrical sleeve 28 by the cooperation of the threaded portion of the drive shaft 21 and the threaded bore 94 of the cylinder head 23. The cooperation of the drive shaft 21 and the cylinder head 23 are discussed hereinbefore with reference to FIG. 8. The support rods 16 are not illustrated for simplification purposes of the schematic illustrations. The reciprocator 11 reciprocates the cylindrical sleeve 28, as the rod 20 and piston 48 remain stationary. The compression and expansion of the pumping chambers 73*a* and 73*b* is provided by the movement of the displacers 59*a* and 59*b* relative to the stationary piston assembly 48 and rod 20.

Figure 15:
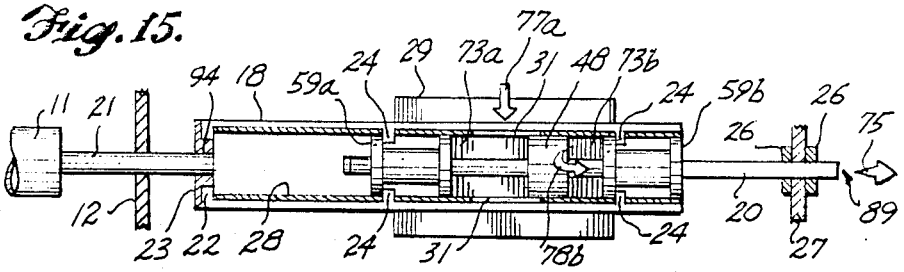
FIGS. 15–18 illustrate schematic, cross-sectional side views of a pumping sequence of the positive displacement pump in accordance with the present invention where the reciprocating motion is applied directly to the sleeve.

The displacers 59*a* and 59*b* are reciprocated by the sliding movement of the cylindrical sleeve 28. The first and second limit stops 24 of the cylinder guides 18 protruding into the cylindrical sleeve 28 move as the cylindrical sleeve 28 is reciprocated. The limit stops 24 engage either flange of the displacers 59*a* and 59*b* and cause the displacers 59*a* and 59*b* to reciprocate within the cylindrical sleeve 28. In FIG. 15, the pumping chamber 73*b* is in a compressed state and the fluid wherein has passed through the piston assembly 48 into the interior of the rod 20, as indicated by arrow 78*b*. The fluid in the pumping chamber 73*b* passes into the internal channel 89 of the rod 20 as discussed hereinbefore with regard to FIGS. 4 and 5 and exits as indicated by arrow 75. The pumping chamber 73*a* is in an expanded state and is communicating with the fluid inlets 31 of the cylindrical sleeve 28, allowing fluid to enter the pumping chamber 73*a* from the fluid accumulator plates 29 as indicated by the arrow 77*a*. The capillary plates of the fluid accumulator 29 wick the fluid to the internal bore 33 passing through the capillary plates containing the cylindrical sleeve 28, thus allowing the fluid to pass through the fluid inlets 31 into the pumping chamber 73*a* by the action of the capillary plates in the pumping chambers 73*a* and 73*b*. In FIG. 15, the cylindrical sleeve 28 has been reciprocated to the extreme left, thus causing limit stop 24 to move the displacer 59*b* to the left and compressing the pumping chamber 73*b* between the displacer 59*b* and the piston assembly 48.

Figure 16:
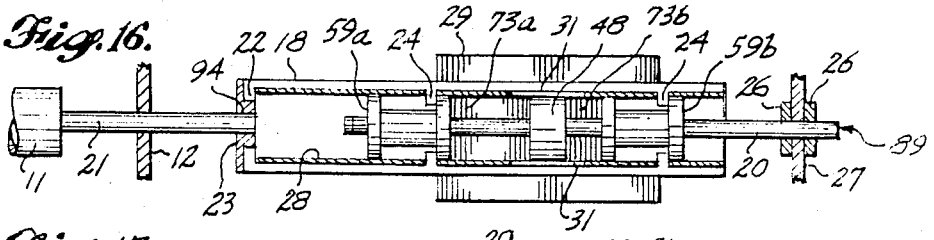
Figure 17:
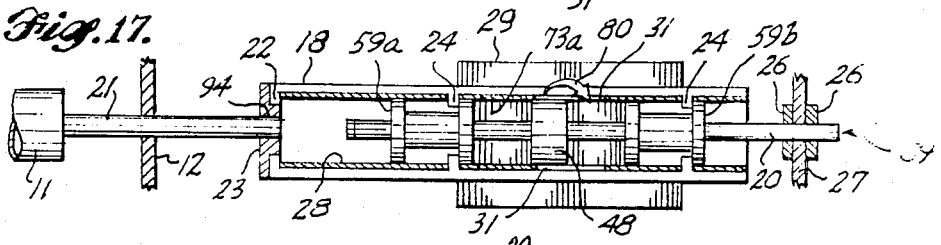

In FIG. 16 the reciprocator 11 has caused the cylindrical sleeve 28 to move to the right as indicated by the change in the position of the cylinder head 23. The displacer limit stops 24 have moved from contacting displacers 59*a* and 59*b* on the left-hand flange to contacting the displacers 59*a* and 59*b* on the right-hand flange. The displacers 59*a* and 59*b* have remained stationary relative to the rod 20 because of the cooperation of the retaining detents 40 and the first and second sets of spring-loaded ball bearings 61 (FIG. 2). The pumping chamber 73*b* has remained in a compressed state and the pumping chamber 73*a* has remained in an expanded state. Both chambers 73*a* and 73*b* are now communicating partially with the long fluid inlets 31. In FIG. 17, as the reciprocator 11 moves the cylindrical sleeve 28 further to the right, as indicated by the change in position of the cylinder head 23, the capillary plates within the pumping chamber 73*a* begin to become compressed causing some of the fluid in the pumping chamber 73*a* to overflow through the fluid inlets 31 and into the pumping chamber 73*b*, thereby partially mechanically priming the pumping chamber 73*b*. The capillary plates in the pumping chamber 73*a* are compressed by the movement of the displacer 59*a* to the right towards the piston assembly 48. The displacer 59*a* is moved to the right by the limit stops 24 engaging the right-hand flange of the displacer 59*a*. In a similar manner, pumping chamber 73*b* is expanded by the movement of the displacer 59*b* to the right away from the piston assembly 48. The displacer 59*b* is moved to the right by the second set of limit stops engaging the right-hand flange of the displacer 59*b*.

Figure 18:
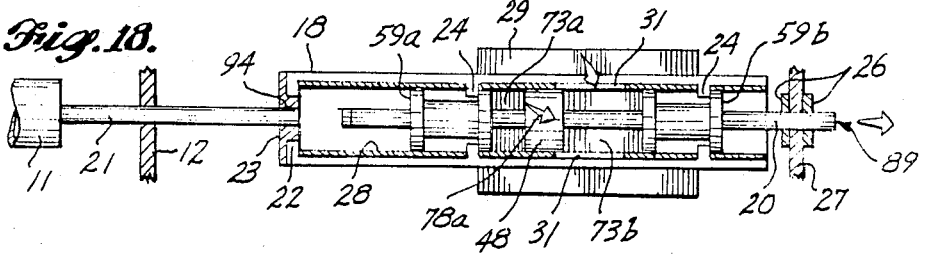

The flow of fluid from pumping chamber 73*a* to 73*b* is indicated by the arrow 80 in FIG. 17. It is possible that the fluid inlets 31 are of a length that will not allow the partial overflow from the expanded chamber 73*a* into the compressed chamber 73*b*. The pumping chamber 73*a* is compressed to a degree sufficient to prevent the fluid within the chamber 73*a* to overflow out the fluid inlets 31 into the pumping chamber 73*b*. As the pumping chamber 73*a* becomes further compressed by the movement of the displacer 59*a* to the right towards the piston assembly 48, as shown in FIG. 18, the fluid in the pumping chamber 73*a* enters the piston assembly 48 passes through the fluid inlet (41 in FIG. 5) of the rod 20 into the internal channel 89. The mechanics by which the fluid enters the piston assembly 48 and passes into the internal channel 89 of the rod 20 is identical to that described hereinbefore with reference to FIGS. 4 and 5, and is the same as that described with reference to FIGS. 10–13. Fluid that has been wicked into the internal bore passing through the capillary plates of the fluid accumulator 29 is then wicked into the expanded pumping chamber 73*b* through the fluid inlets 31 by the action of the capillary plates in the pumping chamber 73*b*. The pump has now gone through one cycle and is ready to compress the pumping chamber 73*b* and expand the pumping chamber 73*a* by reversing the direction that the cylindrical sleeve 28 is moving.

As described in FIG. 14, the reciprocator 11 may be applied directly to a cylindrical sleeve encompassing a plurality of pumping chambers, thus providing a series of several pumps requiring only one common reciprocator 11.

Although particular embodiments of the present invention have been illustrated in the accompanying drawings and described in the foregoing detailed description of the invention, it will be understood that the invention is not limited to the embodiments disclosed, but is intended to embrace any alternatives, modifications, and rearrangements or substitutions of parts or elements as fall within the spirit and scope of the present invention.

The embodiments of the invention in which are exclusive property or privilege is claimed are defined as follows:

1. A positive displacement pump capable of pumping fluids in a zero-gravity environment comprising:

fluid accumulator means capable of being placed in communication with the fluid to be pumped, said fluid accumulator means including a plurality of closely spaced capillary plates, said capillary plates having a longitudinal bore running therethrough in a direction generally orthogonal to the face of said plates;

a sleeve having an exterior surface and an interior surface being positioned in said bore, said capillary plates adjacent said bore being in intimate contact with the exterior surface of said sleeve, said sleeve having a plurality of fluid inlets therein capable of receiving fluid from the spaces between said capillary plates, said inlets communicating between the exterior and interior surfaces of said sleeve;

a rod mounted for reciprocating movement within said sleeve, said rod having a channel running longitudinally therethrough, said rod having a fluid inlet passing through the circumference of said rod, said fluid inlet communicating between the exterior of said rod and said channel;

first and second displacement means mounted for sliding on said rod and spaced from each other;

piston means affixed to the rod intermediate said first and second displacement means defining first and second variable volume chambers on respective sides of said piston, said piston having a fluid channel therein, placing the ends of said piston in fluid communication with the fluid inlet to said rod;

first and second means respectively associated with said sleeve and said first and second displacement means for limiting the sliding movement of said first and second displacement means between first and second alternate positions;

a first set of closely spaced capillary plates positioned in said first variable volume chamber and means for biasing each of said plates a predetermined distance apart while allowing said plates to be compressed toward each other between said piston and said first displacement means;

a second set of closely spaced capillary plates positioned in said second variable volume chamber and means for biasing each of said plates a predetermined distance apart while allowing said plates to be compressed toward each other between said piston and said second displacement means;

first check valve means associated with the fluid channel in said piston for allowing fluid from the first variable volume chamber to flow therefrom into the channel of said rod when said first plurality of capillary plates are compressed;

second check valve means associated with the fluid channel in said piston for allowing fluid from the second variable volume chamber to flow therefrom into the channel of said rod when said second plurality of capillary plates are compressed; and means for reciprocating said rod.

2. The positive displacement pump of claim 1, wherein the capillary plates of the fluid accumulator are spaced apart a distance that provides a capillary pressure sufficient to transport fluid to the fluid inlets of the cylindrical sleeve from a position outside the capillary plates.

3. The positive displacement pump of claim 2, wherein the distance between adjacent capillary plates of the fluid accumulator means ranges from about 0.01 in. to about 0.025 in.

4. The positive displacement pump of claim 3, wherein the distance between adjacent capillary plates ranges from about 0.014 in. to about 0.018 in.

5. The positive displacement pump of claim 1, wherein the bias between adjacent capillary plates contained in each variable volume chamber is sufficient to provide a capillary pressure effective to draw fluid into the variable volume chambers from the fluid inlets of the cylindrical sleeve.

6. The positive displacement pump of claim 5, wherein the bias between adjacent capillary plates contained in each variable volume chamber ranges from about 0.01 in. to about 0.025 in.

7. The positive displacement pump of claim 6, wherein the bias between adjacent capillary plates contained in each variable volume chamber ranges from about 0.014 in. to about 0.018 in.

8. A pumping device comprising a series of positive displacement pumps of claim 1, each pump sharing a common means for reciprocating said rod.

9. The positive displacement pump of claim 1, wherein the capillary plates of the fluid accumulator encompass the fluid inlets of the cylindrical sleeve.

10. A positive displacement pump capable of pumping fluids in a zero-gravity environment comprising:

fluid accumulator means capable of being placed in communication with the fluid to be pumped, said fluid accumulator means including a plurality of closely spaced capillary plates, said capillary plates having a longitudinal bore running therethrough in a direction generally orthogonal to the face of said plates;

a sleeve having an exterior surface and an interior surface being positioned in said bore for sliding, said capillary plates adjacent said bore being in intimate contact with the exterior surface of said sleeve, said sleeve having a plurality of fluid inlets therein capable of receiving fluid from the spaces between said capillary plates, said inlets communicating between the exterior and interior surfaces of said sleeve;

a rod mounted for sliding movement within said sleeve, said rod having a channel running longitudinally therethrough, said rod having a fluid inlet passing through the circumference of said rod, said fluid inlet communicating between the exterior of said rod and said channel;

first and second displacement means mounted for sliding on said rod and spaced from each other;

piston means affixed to the rod intermediate said first and second displacement means defining first and second variable volume chambers on respective sides of said piston, said piston having a fluid channel therein placing the ends of said piston in fluid communication with the fluid inlet to said rod;

first and second means respectively associated with said sleeve and said first and second displacement means for limiting the sliding movement of said first and second displacement means between first and second alternate positions;

a first set of closely spaced capillary plates positioned in said first variable volume chamber and means for biasing each of said plates a predetermined distance apart while allowing said plates to be compressed toward each other between said piston and said first displacement means;

a second set of closely spaced capillary plates positioned in said second variable volume chamber and means for biasing each of said plates a predetermined distance apart while allowing said plates to be compressed toward each other between said piston and said second displacement means;

first check valve means associated with the fluid channel in said piston for allowing fluid from the first variable volume chamber to flow therefrom into the interior of said rod when said first plurality of capillary plates are compressed;

second check valve means associated with the fluid channel in said piston for allowing fluid from the second variable volume chamber to flow therefrom into the interior of said rod when said second plurality of capillary plates are compressed; and means for reciprocating said sleeve.

11. The positive displacement pump of claim 10, wherein the bias between adjacent capillary plates contained in each variable volume chamber is sufficient to provide a capillary pressure effective to draw fluid into the variable volume chambers from the fluid inlets of the cylindrical sleeve.

12. The positive displacement pump of claim 11, wherein the bias between adjacent capillary plates contained in each variable volume chamber ranges from about 0.01 in. to about 0.025 in.

13. The positive displacement pump of claim 12, wherein the bias between adjacent capillary plates contained in each variable volume chamber ranges from about 0.014 in. to about 0.018 in.

14. A pumping device comprising a series of positive displacement pumps of claim 10, said pumps sharing a common means for reciprocating said sleeve.

15. The positive displacement pump of claims 1 or 10, wherein the fluid to be pumped is a saturated fluid.

16. The positive displacement pump of claim 15, wherein the fluid to be pumped is saturated liquid water.

17. The positive displacement pump of claim 1 or 10, wherein only one variable volume chamber communicates with the fluid inlets of the cylindrical sleeve at one time.

18. The positive displacement pump of claim 5 or 11, wherein the capillary plates contained in each variable volume chamber further include alternating concave and flat plates.

19. The positive displacement pump of claim 18, wherein the capillary plates contained in each variable volume chamber are made from titanium.

* * * * *

UNITED STATES PATENT AND TRADEMARK OFFICE

CERTIFICATE OF CORRECTION

PATENT NO. : 4,830,588

DATED : May 16, 1989

INVENTOR(S) : Ronald C. Zentner

It is certified that error appears in the above-identified patent and that said Letters Patent is hereby corrected as shown below:

| Column | Line | Error |
|---|---|---|
| 7 | 17 | "still" should be --still,-- |
| 11 | 68 | "dicussed" should be --discussed-- |
| 18 | 59 | "wherein" should be --therein-- |
| 20 | 17 | "are" should be --an-- |

Signed and Sealed this

Twenty-eighth Day of August, 1990

*Attest:*

HARRY F. MANBECK, JR.

*Attesting Officer*

*Commissioner of Patents and Trademarks*